US012565882B2

(12) United States Patent
Yeh

(10) Patent No.: US 12,565,882 B2
(45) Date of Patent: Mar. 3, 2026

(54) PIEZOELECTRIC PUMPS AND ELECTRONIC DEVICES

(71) Applicant: Nanning FuLian FuGui Precision Industrial Co., Ltd., Nanning (CN)

(72) Inventor: Chih-Yu Yeh, New Taipei (TW)

(73) Assignee: Nanning FuLian FuGui Precision Industrial Co., Ltd., Nanning (CN)

( * ) Notice: Subject to any disclaimer, the term of this patent is extended or adjusted under 35 U.S.C. 154(b) by 8 days.

(21) Appl. No.: 18/780,547

(22) Filed: Jul. 23, 2024

(65) Prior Publication Data

US 2026/0028978 A1 Jan. 29, 2026

(51) Int. Cl.
*F04B 45/047* (2006.01)

(52) U.S. Cl.
CPC ..... *F04B 45/047* (2013.01)

(58) Field of Classification Search
CPC ..... F04B 43/046; F04B 45/067
See application file for complete search history.

(56) References Cited

U.S. PATENT DOCUMENTS 7,553,135 B2 6/2009 Cho et al.
11,162,487 B2 * 11/2021 Mou ..... F04B 53/20
2006/0232167 A1 10/2006 Jordan
2011/0061526 A1 3/2011 Wackerle et al.
2014/0178223 A1 * 6/2014 Kim ..... F04B 43/046 417/437
2020/0232451 A1 * 7/2020 Tanaka ..... F04B 53/1037
2023/0287904 A1 9/2023 Hatfield et al.

FOREIGN PATENT DOCUMENTS

CN 205349676 U 6/2016
CN 108317093 A 7/2018
EP 1515043 B1 11/2006
WO WO-2019138676 A1 * 7/2019 ..... F04B 45/10

* cited by examiner

*Primary Examiner* — Thomas Fink
(74) *Attorney, Agent, or Firm* — ScienBiziP, P.C.

(57) ABSTRACT

A piezoelectric pump and an electronic device are provided. The piezoelectric pump is mounted on the electronic device, and includes a housing, an inlet structure, and an outlet structure, and a piezoelectric vibration mechanism. The housing includes first openings and second openings. The inlet structure is disposed on the inner surface of the housing, and includes an inlet body having inlet holes positioned correspondingly to the first openings; and first films connected to the inlet body, and in the inlet holes. The outlet structure is disposed on the outer surface of the housing, and includes outlet body having outlet holes positioned correspondingly to the second openings; and second films connected to the outlet body, and in the outlet holes. The piezoelectric vibration mechanism is in the housing.

13 Claims, 7 Drawing Sheets

PIEZOELECTRIC PUMPS AND ELECTRONIC DEVICES

FIELD

The subject matter herein generally relates to piezoelectric pumps and electronic devices with the piezoelectric pumps.

BACKGROUND

Optical communication servers are equipped with a large number of optical communication modules. In order to facilitate the installation of the optical communication modules, the optical communication modules will first be installed in a detachable housing, and then the detachable housing will be installed into the optical communication server through the front side of the chassis of the optical communication server. In addition, the heat dissipation of optical communication servers mainly involves installing multiple fans on the back side of the chassis, and the fans generate airflow toward the detachable housing for heat dissipation.

However, due to the increase in transmission speed of optical communication modules, a large amount of heat is generated. The air flow generated by the fan on the chassis is difficult to enter the interior of the optical communication module through the detachable housing, making it difficult to meet the heat dissipation requirements for the optical communication module.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. It will be appreciated that for simplicity and clarity of illustration, where appropriate, reference numerals have been repeated among the different figures to indicate corresponding or analogous elements.

DETAILED DESCRIPTION

Figure 1:
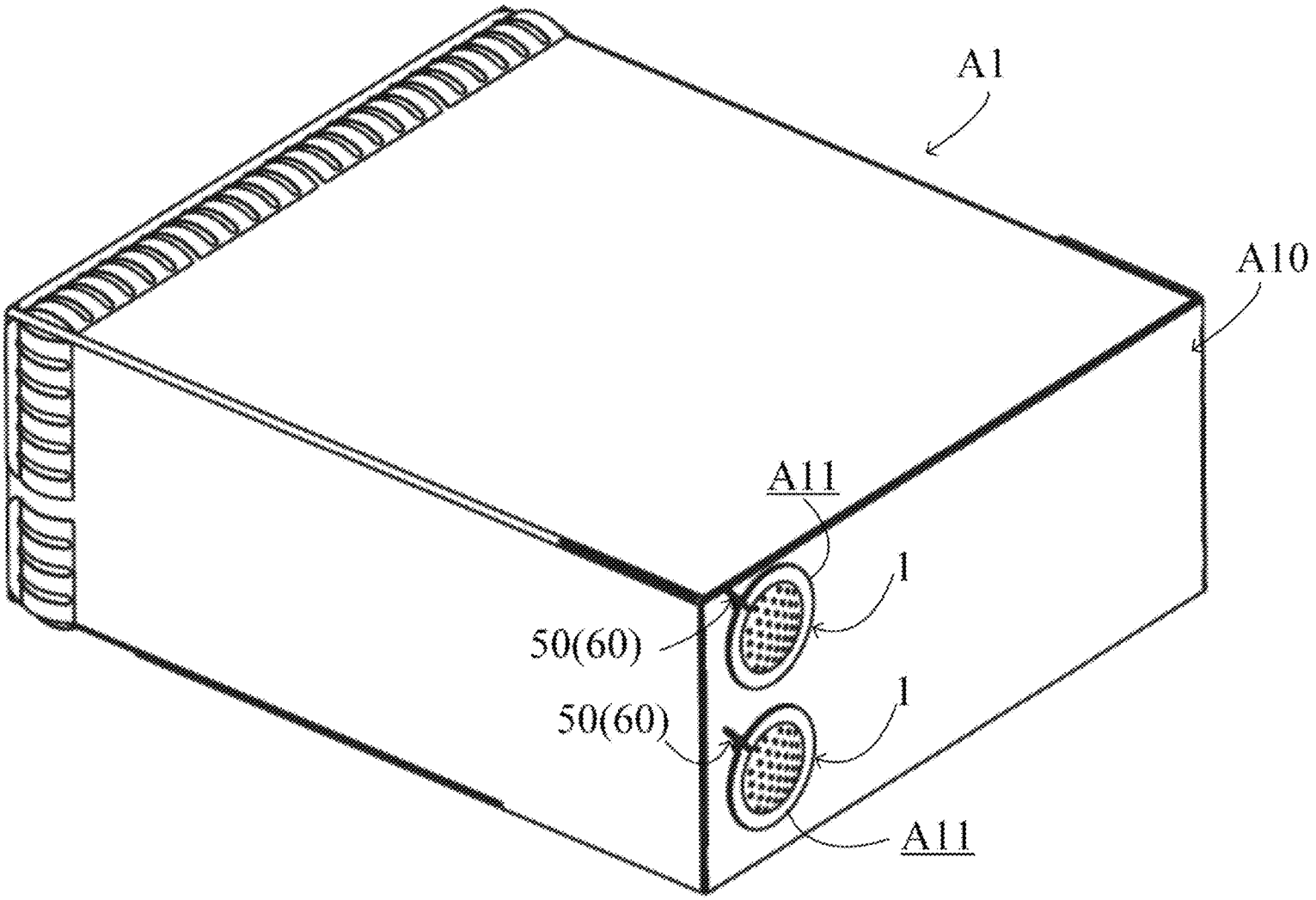
FIG. 1 is a perspective view of an electronic device and piezoelectric pumps in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of embodiments and not by way of limitation in the figures of the accompanying drawings, in which like references indicate similar elements. It should be noted that references to "an" or "one" embodiment in this disclosure are not necessarily to the same embodiment, and such references mean "at least one."

The term "connect" is defined as directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

In the present disclosure, thin and miniaturized piezoelectric pumps are mounted on the detachable chassis. The piezoelectric pumps can directly dissipate heat for each optical communication module in removable chassis to achieve requirement heat dissipation performance for the optical communication modules.

FIG. 1 is a perspective view of an electronic device A1 and piezoelectric pumps 1 in accordance with an embodiment of the present disclosure. The electronic device A1, may be a network communication device, but not limited there to. In one embodiment, the electronic device A1 may be an optical communication device, and optical communication modules are disposed in the electronic device A1. The optical communication modules can be detachably disposed in the electronic device A1, and optical fibers are connected to the optical communication modules. Moreover, the chassis A10 of the electronic device A1 are detachable chassis. One or more electronic device A1 are detachably mounted in an electronic apparatus, such as a network communication servers.

The piezoelectric pumps 1 are mounted on the mounting holes A11 of the chassis A10 of the electronic device A1. Each mounting hole A11 and each piezoelectric pump 1 are positioned correspondingly one optical communication module. The piezoelectric pumps 1 are used to generate air flow to dissipate heat from electronic device A1. In the embodiment, there are two piezoelectric pumps 1 shown in FIG. 1. However, the number of the piezoelectric pumps 1 is not limited. The piezoelectric pumps 1 can cover more than 70% area of the wall of the chassis A10.

Figure 2B:
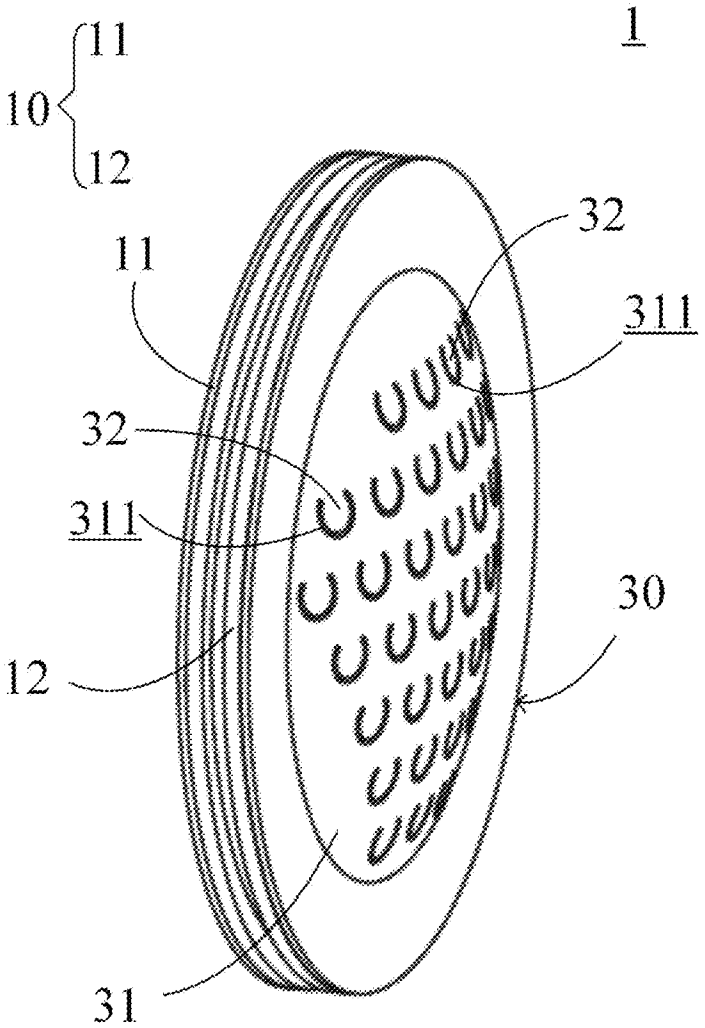
FIG. 2A and FIG. 2B are perspective views of the piezoelectric pump shown in FIG. 1.
Figure 2A:
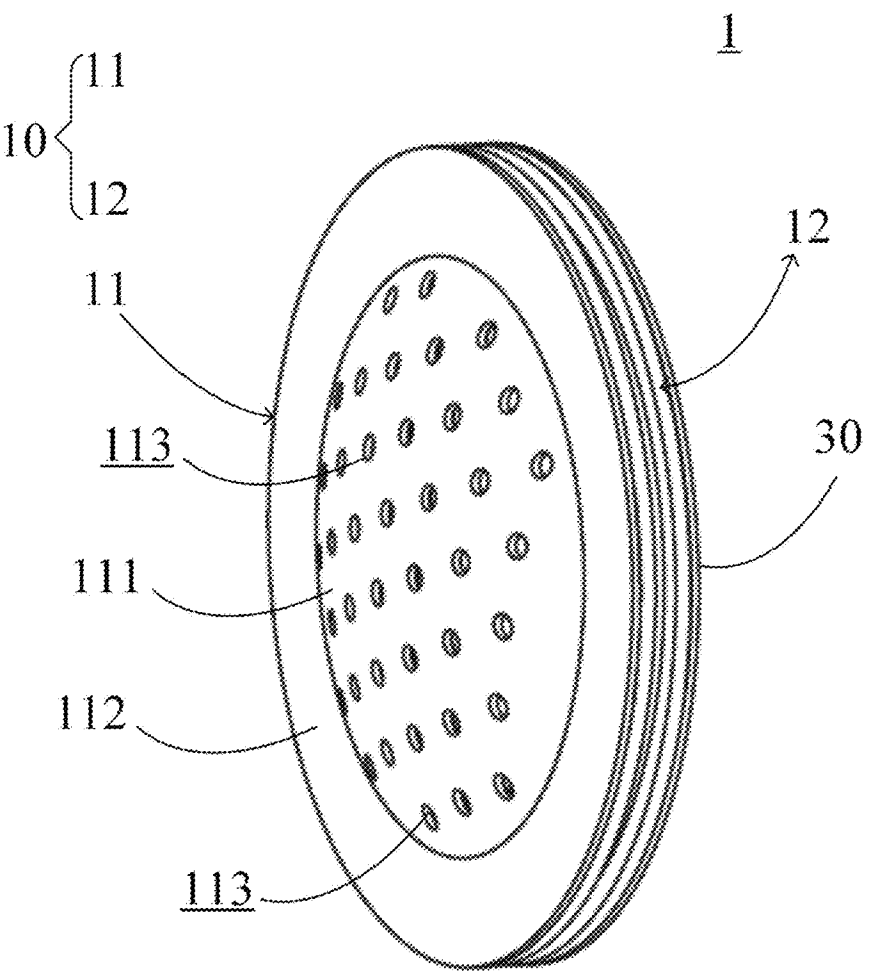
Figure 3A:
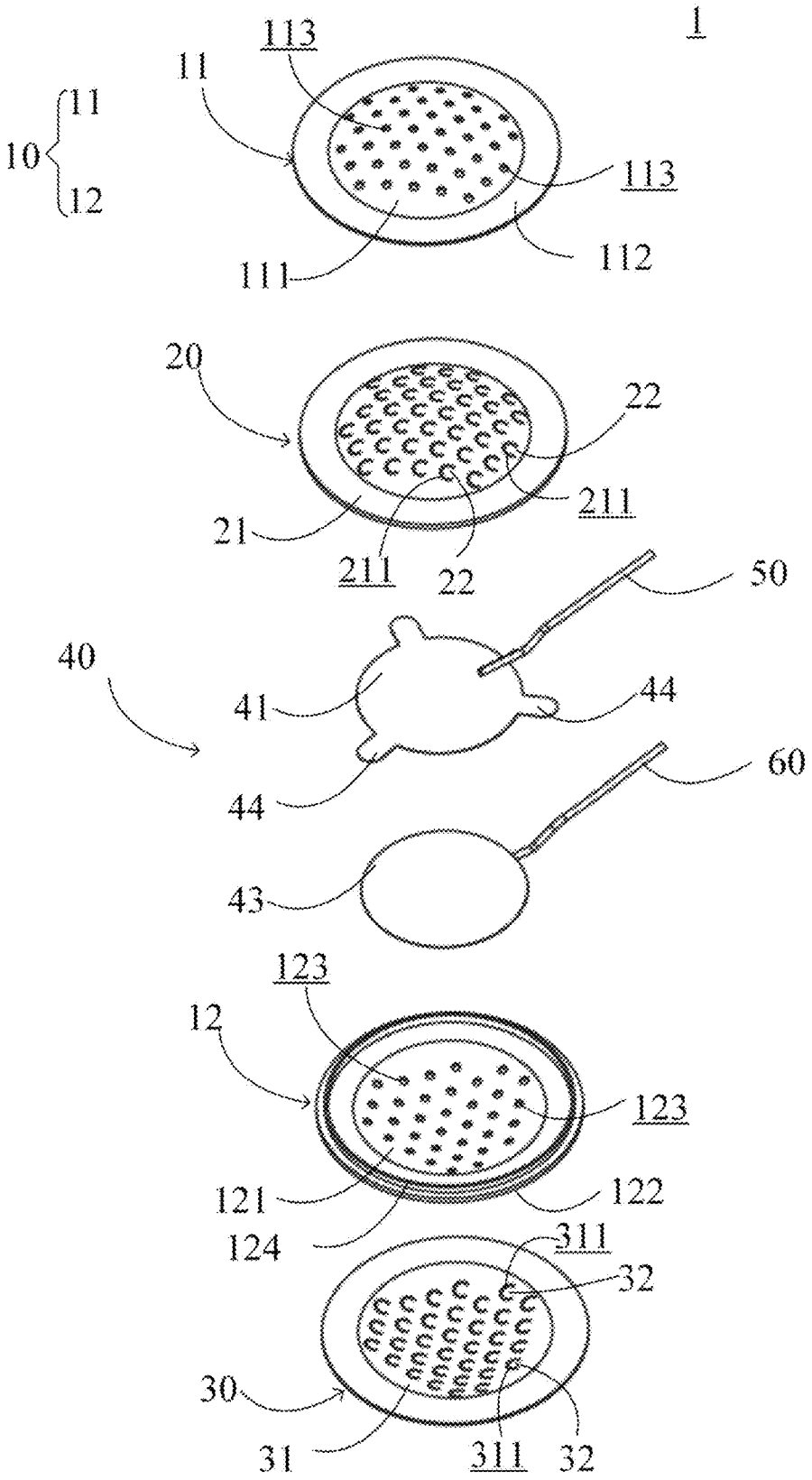
FIG. 3A and FIG. 3B are exploded views of the piezoelectric pump shown in FIG. 1.
Figure 3B:
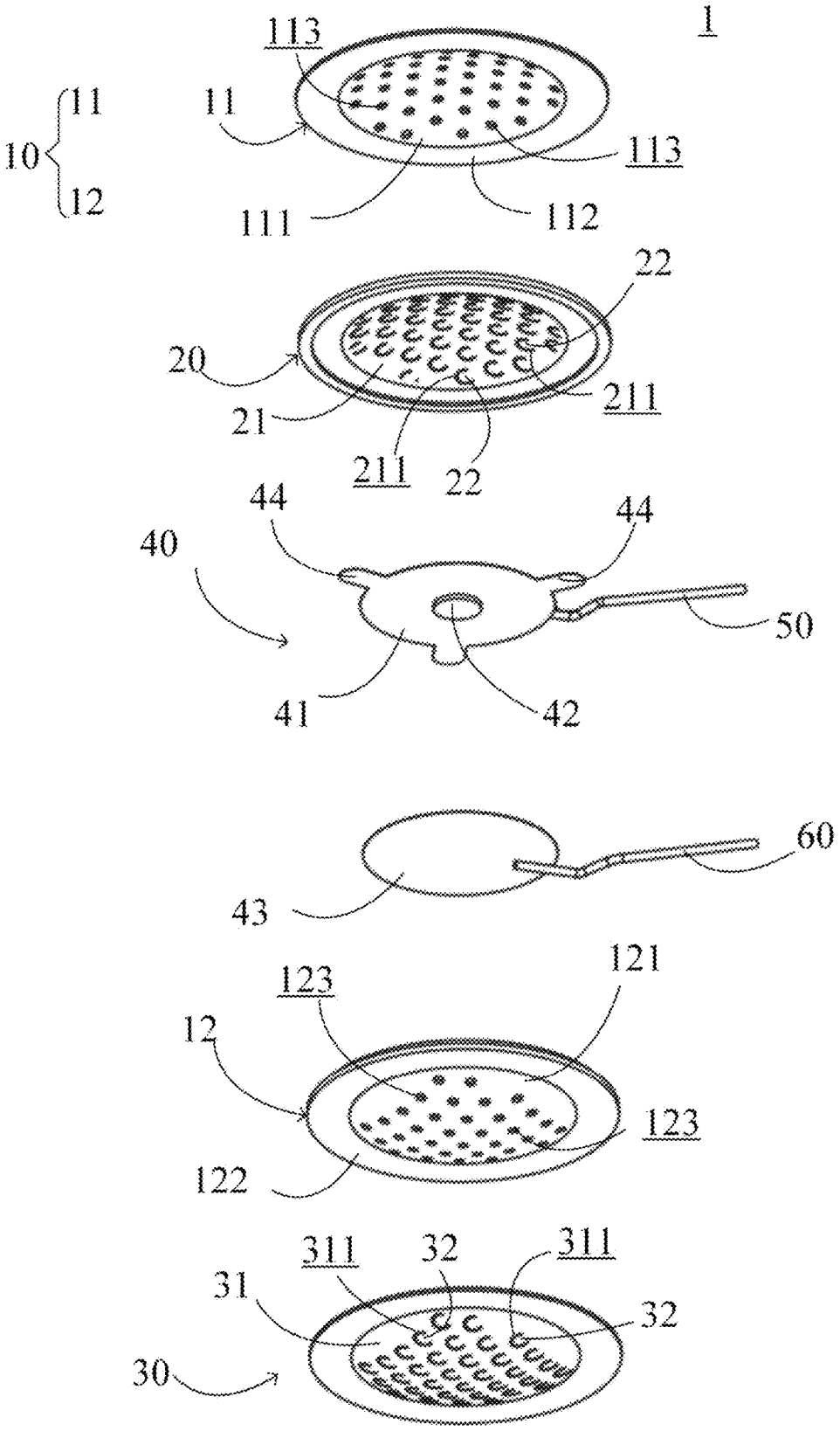
Figure 4:
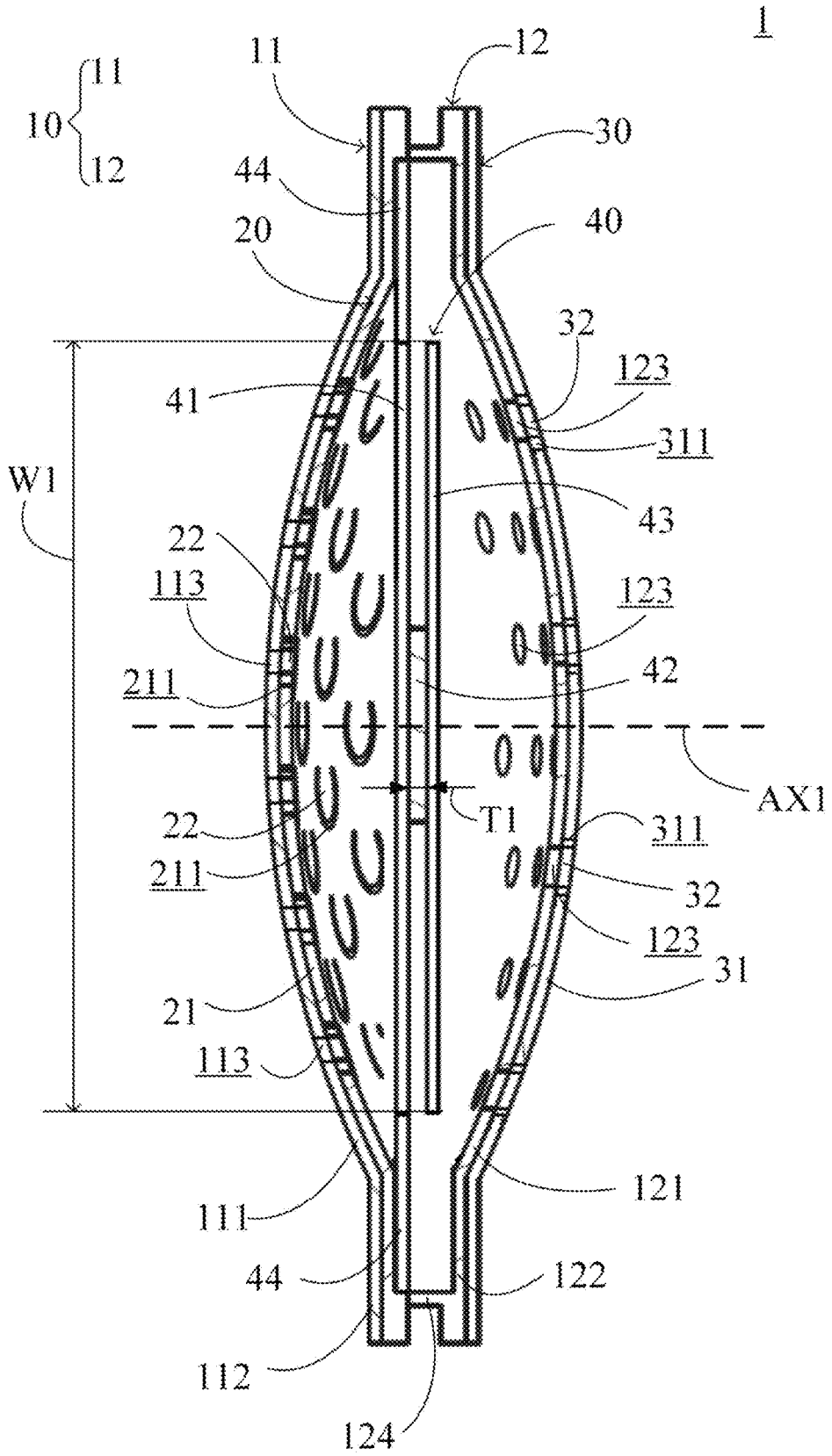
FIG. 4 is a cross-sectional view of the piezoelectric pump shown in FIG. 1.

FIG. 2A and FIG. 2B are perspective views of the piezoelectric pump 1 shown in FIG. 1. FIG. 3A and FIG. 3B are exploded views of the piezoelectric pump 1 shown in FIG. 1. FIG. 4 is a cross-sectional view of the piezoelectric pump 1 shown in FIG. 1. In FIG. 4, the piezoelectric pump 1 is in an initial state. The piezoelectric pump 1 includes a housing 10, an inlet structure 20, an outlet structure 30, a piezoelectric vibration mechanism 40, a first wire 50, and a second wire 60. For the purpose of clarity, the first wire 50 and the second wire 60 are not shown in FIG. 2A, FIG. 2B and FIG. 4.

The housing 10 is a thin hollow structure. In the embodiment, the housing 10 includes a first housing 11, and a second housing 12. The first housing 11 covers the second housing 12. The first housing 11 includes a first dome portion 111, a first annulus portion 112, and first openings 113. The first dome portion 111 is a dome-shaped structure. A central axis AX1 is an imaginary central axis, passing through the center of the first dome portion 111. The first annulus portion 112 surrounds the first dome portion 111 and the central axis AX1. The first annulus portion 112 extends along an imaginary plane, which is perpendicular to the central axis AX1, and the center of the first dome portion 111 protrudes the plane. The first openings 113 are distributed on the first dome portion 111. In the embodiment, the first dome portion 111 and the first annulus portion 112 can be an integrally formed, and can be made of the same materials, such as metal or plastic.

Moreover, in the embodiment, the width of the housing 10 is longer than the thickness of the housing 10. The width of the housing 10 is longer than 3 times the thickness of the housing 10. In one embodiment, the width of the housing 10 is in the range of 7.5 mm to 21 mm, and the thickness of the housing 10 is in the range of 2.5 mm to 7 mm. The width of the housing 10 is measured in a direction, which is perpendicular to the central axis AX1, and the thickness of the housing 10 is measured in a direction, which is parallel to the central axis AX1. Therefore, the piezoelectric pump 1 of this embodiment can have the advantages of thinning and miniaturization. Each optical communication module in the electronic device A1 can be configured with one piezoelectric pump 1, so that heat dissipation can be performed separately for each optical communication module in the electronic device A1.

The second housing 12 includes a second dome portion 121, a second annulus portion 122, second openings 123, and a connection ring 124. The second dome portion 121 may be a dome-like structure. The central axis AX1 extends through the center of the second dome portion 121. The second annulus portion 122 surrounds the second dome portion 121 and the central axis AX1. The second annulus portion 122 extends along an imaginary plane, which is perpendicular to the central axis AX1, and the center of the second dome portion 121 protrudes over the plane. The second openings 123 are distributed on the second dome portion 121. In the embodiment, the second dome portion 121 and the second annulus portion 122 are integrally formed, and can be made of the same materials, such as metal or plastic.

The connection ring 124 is disposed on the second annulus portion 122. When the first housing 11 covers the second housing 12, the connection ring 124 contacts the first annulus portion 112. In another embodiment, the connection ring 124 is disposed on the first annulus portion 112. When the first housing 11 covers the second housing 12, the connection ring 124 contacts the second annulus portion 122. In other words, the connection ring 124 is between the first annulus portion 112 and the second annulus portion 122.

In the embodiment, the distance between the center of the first dome portion 111 and the center of the second dome portion 121 is longer than the edge of the first dome portion 111 and the edge of the second dome portion 121, and is longer than the distance between the first annulus portion 112 and the second annulus portion 122. The edge of the first dome portion 111 is connected to the first annulus portion 112, and the edge of the second dome portion 121 is connected to the second annulus portion 122. When the piezoelectric pump 1 is disposed on the mounting hole A11 of the chassis A10 in FIG. 1, the connection ring 124 can contact the side wall of the mounting hole A11, and the chassis A10 is between the first annulus portion 112 and the second annulus portion 122. Therefore, the piezoelectric pump 1 can be easily installed on the chassis A10.

The inlet structure 20 is disposed on the inner surface of the first housing 11 of the housing 10. The inner surface of the first housing 11 is in the housing 10, and faces the second housing 12. The inlet structure 20 includes an inlet body 21 and first films 22. The inlet body 21 is attached on the inner surface of the first dome portion 111 and the first annulus portion 112 of the first housing 11. The inner surface of the first dome portion 111 is within the housing 10, and faces the second dome portion 121. The inner surface of the first annulus portion 112 is within the housing 10, and faces the second annulus portion 122. In another embodiment, the inlet body 21 is separated from the first annulus portion 112.

The inlet body 21 includes inlet holes 211, positioned correspondingly to the first openings 113. Each first film 22 is connected to one inlet body 21, and in one inlet hole 211. In the embodiment, the inlet structure 20 includes at least ten first films 22 and inlet holes 211, but not limited thereto. Moreover, the area and width of the first opening 113 are less than the area and width of the inlet hole 211, and less than the area and width of the first film 22. Therefore, in the initial state of FIG. 4, the first film 22 completely covers the first opening 113. In the embodiment, the inlet body 21 and the first films 22 are integrally formed, and can be made of the same materials, such as silicone or rubber. The first films 22 are flexible relative to the inlet body 21. In other words, the first films 22 can be rotated relative to the inlet body 21.

The outlet structure 30 is disposed on the outer surface of the second housing 12 of the housing 10. The inner surface of the second housing 12 is in the housing 10, and faces the first housing 11. The outlet structure 30 includes an outlet body 31 and second films 32. The outlet body 31 is attached on the outer surface of the second dome portion 121 and the second annulus portion 122 of the second housing 12. The inner surface of the second dome portion 121 is in the housing 10, and faces the first dome portion 111. The inner surface of the second annulus portion 122 is in the housing 10, and faces the first annulus portion 112. In another embodiment, the outlet body 31 is separated from the second annulus portion 122.

The outlet body 31 includes outlet holes 311, and positioned correspondingly to the second openings 123. Each second films 32 is connected to the outlet body 31, and in the outlet hole 311. In the embodiment, the outlet structure 30 includes at least ten second films 32 and outlet holes 311, but not limited thereto. Moreover, the area and width of the second opening 123 are less than the area and width of the outlet hole 311, and less than the area and width of the second film 32. Therefore, in the initial state of FIG. 4, the second film 32 completely covers the second opening 123. In the embodiment, the outlet body 31 and the second films 32 are integrally formed, and can be made of the same materials, such as silicone or rubber. The second films 32 are flexible relative to the outlet body 31. In other words, the second films 32 can be rotated relative to the inlet body 21.

In another embodiment, the inlet structure 20 does not includes the inlet body 21. The first films 22 are rotatably affixed to the first housing 11, and cover the first openings 113. The outlet structure 30 does not includes outlet body 31. The second films 32 are rotatably affixed to the first housing 11, and cover the second opening 123.

In the embodiment, the housing 10 is made of hard materials, such as metal or plastic. The inlet structure 20 and the outlet structure 30 are made of soft materials, such as silicone or rubber. The hardness of the housing 10 is greater than the hardness of the inlet structure 20 and the outlet structure 30. Therefore, the first housing 11 can support the shape of the inlet body 21, and enable the first films 22 to cover the first openings 113 in the initial state. In addition, the second housing 12 can support the shape of the outlet body 31, and enable the second films 32 to cover the second opening 123 in the initial state.

The piezoelectric vibration mechanism 40 is disposed in the housing 10. The piezoelectric vibration mechanism 40 includes a first vibration plate 41, a piezoelectric element 42, a second vibration plate 43, and support structures 44. The first vibration plate 41 and the second vibration plate 43 are disposed in the housing 10, and between the first dome portion 111 and the second dome portion 121. The first vibration plate 41 is separated from the first housing 11, the second housing 12, the inlet body 21, and the outlet body 31. Moreover, the first vibration plate 41 is separated from the first housing 11, the second housing 12, the inlet body 21, and the outlet body 31. The piezoelectric element 42 is affixed to the center of the first vibration plate 41 and the center of the second vibration plate 43. The piezoelectric element 42 is affixed between the first vibration plate 41 and the second vibration plate 43.

In the embodiment, the central axis AX1 can pass through the centers of the first housing 11, the inlet body 21, the first vibration plate 41, the piezoelectric element 42, the second vibration plate 43, the second housing 12, and the outlet body 31 in sequence. The first vibration plate 41, the piezoelectric element 42, and the second vibration plate 43 extend perpendicular to the central axis AX1. In the initial vibration state of FIG. 4, the first vibration plate 41 is parallel to the second vibration plate 43, and separated from the second vibration plate 43.

The support structures 44 are connected to the first vibration plate 41 or the second vibration plate 43, and the support structures 44 are connected or affixed to the housing 10. In the embodiment, the support structures 44 are connected to the edge of the first vibration plate 41, and affixed to the first housing 11. In another embodiment, the support structures 44 are connected to the edge of the second vibration plate 43, and connected to the second housing 12.

In the embodiment, the width W1 of the first vibration plate 41 and the second vibration plate 43 is less than the widths of the housing 10, the inlet structure 20, and the outlet structure 30, wherein the width W1 and the widths of the housing 10, the inlet structure 20, and the outlet structure 30 are measured in the same direction, which is perpendicular to the central axis AX1. In the initial state of FIG. 4, the thickness of the first vibration plate 41 and the second vibration plate 43 is less than the thickness T1 of the piezoelectric element 42. The thickness of the first vibration plate 41 and the second vibration plate 43 and the thickness T1 are measured in the direction, which is parallel to the central axis AX1.

The first wire 50 shown in FIG. 3A and FIG. 3B is connected to the first vibration plate 41, and the second wire 60 is connected to the second vibration plate 43. The first vibration plate 41 and second vibration plate 43 are made of conductive materials. The electronic device A1 can provide alternating current to the first vibration plate 41 and the second vibration plate 43 through the first wire 50 and the second wire 60, so that the first vibration plate 41 and the second vibration plate 43 can generate the first electric field and the second electric field in alternating directions. In other words, the direction of the first electric field is opposite to the second electric field. The first electric field and the second electric field can be parallel to the central axis AX1.

During the first electric field and the second electric field in alternating directions applying to the piezoelectric element 42, the piezoelectric element 42 is alternately contracted and expanded in the central axis AX1, thereby causing the first vibration plate 41 and the second vibration plate 43 to vibrate. For example, the frequency of the first electric field and the second electric field alternating is more than 100 times per second. It should be noted that the piezoelectric element 42 contracted and expended through alternating electric fields is a conventional technology, and thus the materials, internal structure and operating principle of the piezoelectric element 42 are not further explained in this specification.

Figure 5A:
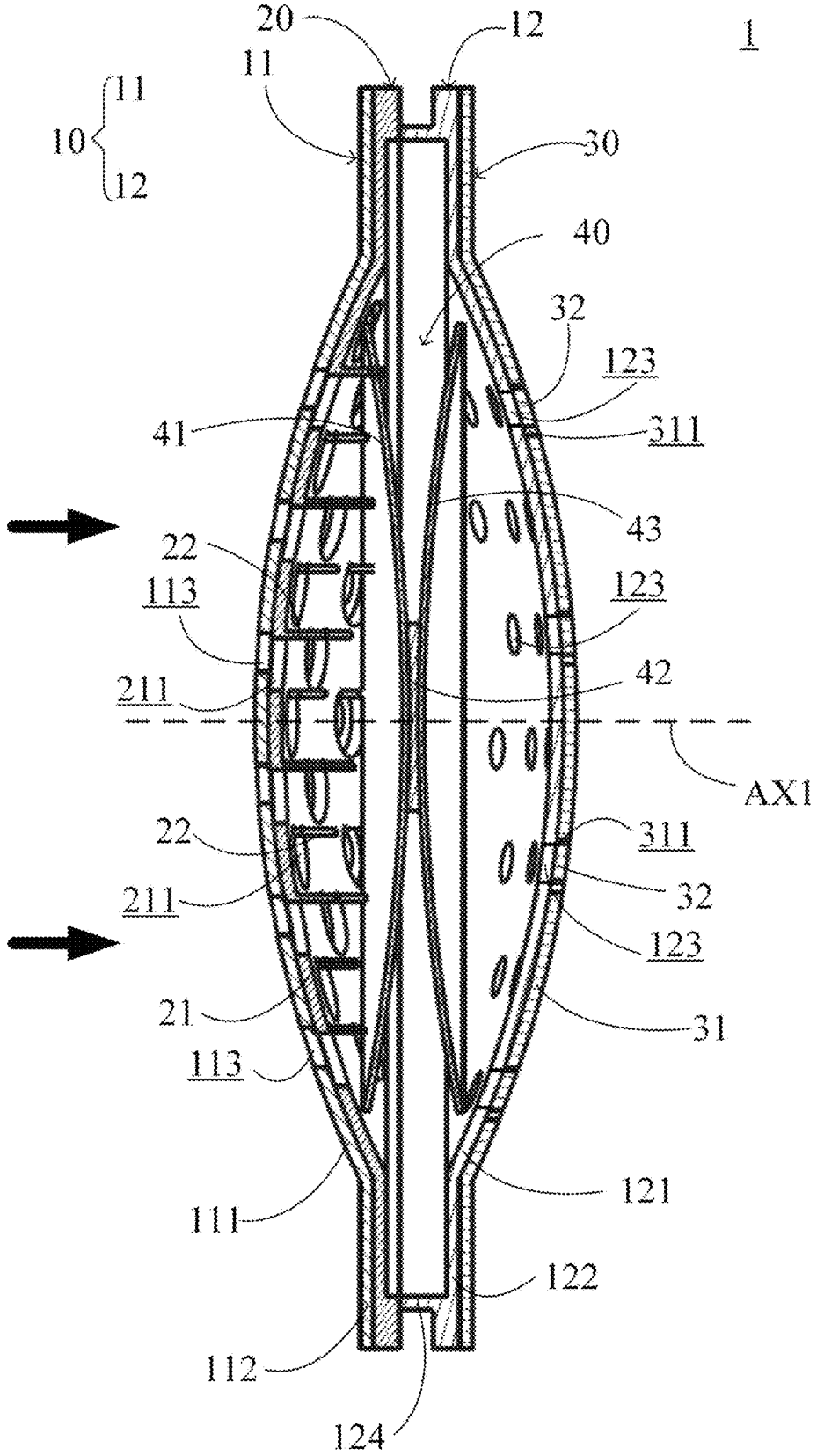
FIG. 5A is a schematic diagram of the piezoelectric pump in an inlet stage.

FIG. 5A is a schematic diagram of the piezoelectric pump 1 in an inlet stage. In the inlet stage, the air out of the piezoelectric pump 1 flows into the housing 10 via the first openings 113 and the inlet holes 211. The first vibration plate 41 and the second vibration plate 43 apply the first electric field to the piezoelectric element 42. When the first electric field is applied to the piezoelectric element 42, the piezoelectric element 42 is contracted in the central axis AX1. At this time, the thickness of the edge of the piezoelectric element 42 is greater than the thickness of the center of the piezoelectric element 42. In other words, two opposite surfaces of the piezoelectric element 42 are transformed as concave surfaces. Since the centers of the first vibration plate 41 and the second vibration plate 43 are affixed on the two opposite surfaces of the piezoelectric element 42, the first vibration plate 41 and the second vibration plate 43 are transformed as concave shapes. At this time, the distance between the edge of the first vibration plate 41 and the edge of the second vibration plate 43 is longer than the distance between the center of the first vibration plate 41 and the center of the second vibration plate 43.

In the inlet stage, since the distance between the edge of the first vibration plate 41 and the edge of the second vibration plate 43 increases, the air in the housing 10 flows into the space between the edge of the first vibration plate 41 and the edge of the second vibration plate 43. At this time, the air pressure between the inlet structure 20 and the first vibration plate 41 decreases, so the air outside the housing 10 flows into the housing 10 via the first openings 113 and the inlet holes 211, thereby generating air flow.

When the air flows into the housing 10 via the first openings 113, the air pushes the first films 22 so that the first films 22 rotate relative to the inlet body 21, and the air can flows into the housing 10 via the inlet holes 211. In other words, when the air pushes the first films 22 to rotate relative to the inlet body 21, the free ends of the first films 22 are separated from the inlet holes 211 and the first housing 11.

In addition, in the inlet stage, the air pressure between the second housing 12 and the second vibration plate 43 is also decreased. However, the area and width of the second opening 123 of the second housing 12 are less than the area and width of the outlet hole 311, and less than the area and width of the second film 32. Therefore, the air outside the housing 10 cannot push the second films 32 to rotate toward the inside of the housing 10, so the second films 32 block the air from entering the housing 10 via the second openings 123 and the outlet holes 311.

Figure 5B:
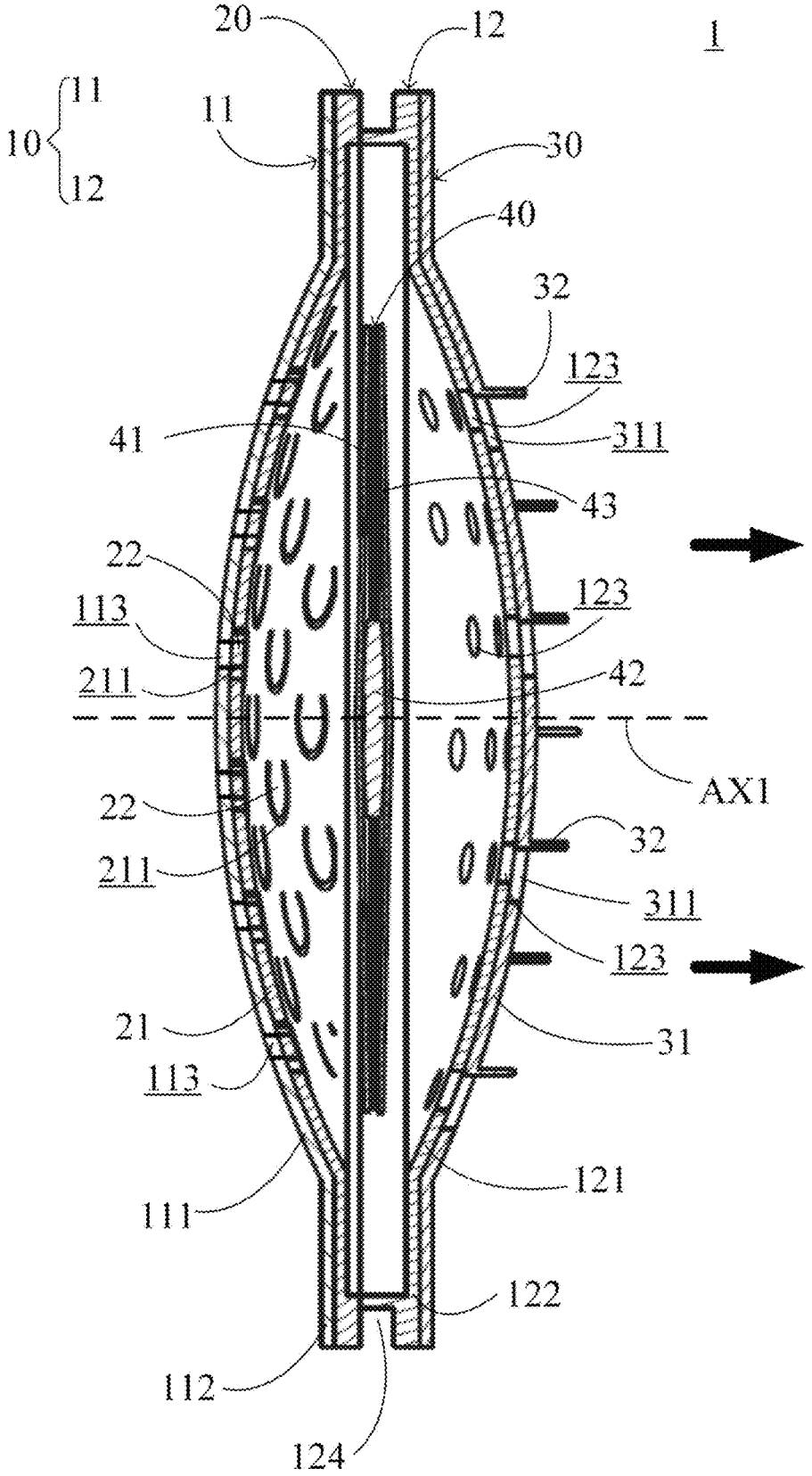
FIG. 5B is a schematic diagram of the piezoelectric pump in an outlet stage.

FIG. 5B is a schematic diagram of the piezoelectric pump 1 in an outlet stage. In the outlet stage, the air inside the housing 10 is exhausted outside the housing 10 via the second openings 123 and the outlet holes 311. The first vibration plate 41 and the second vibration plate 43 apply the second electric field to the piezoelectric element 42. When the second electric field is applied to the piezoelectric element 42, the piezoelectric element 42 is expended in the central axis AX1. At this time, the thickness of the center of the piezoelectric element 42 is greater than the thickness of the edge of the piezoelectric element 42. In other words, two opposite surfaces of the piezoelectric element 42 are transformed as convex surfaces. Since the centers of the first vibration plate 41 and the second vibration plate 43 are affixed on the two opposite surfaces of the piezoelectric element 42, the first vibration plate 41 and the second vibration plate 43 are transformed as convex shapes. At this time, the distance between the center of the first vibration plate 41 and the center of the second vibration plate 43 is longer than the distance between the edge of the first vibration plate 41 and the edge of the second vibration plate 43.

In the outlet stage, since the distance between the edge of the first vibration plate 41 and the edge of the second vibration plate 43 is reduced, the air in the housing 10 is exhausted between the edge of the first vibration plate 41 and the edge of the second vibration plate 43. At this time, the air pressure between the second housing 12 and the second vibration plate 43 increases, so the air in the housing 10 is exhausted outside the housing 10 through the second openings 123 and the outlet holes 311, thereby generating air flow.

When the air passes through the second openings 123, the air pushes the second films 32 so that the second films 32 rotate relative to the outlet body 31, and the air can be exhausted outside the housing 10 via the outlet holes 311. In other words, when the air pushes the second films 32 to rotate relative to the outlet body 31, the free ends of the second films 32 separates from the outlet holes 311 and the second housing 12.

In addition, in the outlet stage, the air pressure between the inlet structure 20 and the first vibration plate 41 is also increased. However, the area and width of the first opening 113 of the first housing 11 are less than the area and width of the inlet hole 211, and less than the area and width of the first film 22. Therefore, the air in the housing 10 cannot push the first film 22 to rotate into the first openings 113, so the first films 22 block the air from being exhausted outside the housing 10 via the first openings 113 and the inlet holes 211.

In conclusion, the piezoelectric pump 1 of the present disclosure generates air flows by the piezoelectric element 42 vibrating the first vibration plate 41 and the second vibration plate 43, thereby dissipating heat inside the electronic device A1. In addition, the piezoelectric pump 1 has the advantages of being small and thin, and the volume of the electronic device A1 occupied by the piezoelectric pump 1 can be reduced.

Many details are often found in the relevant art, thus many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will, therefore, be appreciated that the embodiments described above may be modified within the scope of the claims.

What is claimed is:

1. A piezoelectric pump comprising:

a housing comprising a plurality of first openings and a plurality of second openings;

an inlet structure disposed on an inner surface of the housing, and comprising:

an inlet body comprising a plurality of inlet holes positioned correspondingly to the plurality of first openings; and a plurality of first films connected to the inlet body, and the plurality of first films being in the inlet holes;

an outlet structure disposed on an outer surface of the housing, and comprising:

an outlet body comprising a plurality of outlet holes positioned correspondingly to the plurality of second openings; and a plurality of second films connected to the outlet body, and a plurality of second films being in the outlet holes; and a piezoelectric vibration mechanism disposed in the housing, and comprising:

a first vibration plate disposed in the housing;

a piezoelectric element affixed to the first vibration plate; and a second vibration plate affixed to the piezoelectric element, wherein in response to the piezoelectric element is alternately applied with a first electric field and a second electric field by the first vibration plate and the second vibration plate, respectively, the piezoelectric element alternately contracts and expands to vibrate the first vibration plate and the second vibration plate, respectively, and a direction of the first electric field is opposite to a direction of the second electric field, wherein the air flows into the housing via the first openings and the inlet holes by pushing the first films in an inlet stage, and the air flows out of the housing via the second openings and the outlet holes by pushing the second films in an outlet stage.

2. The piezoelectric pump is claimed in claim 1, wherein the piezoelectric element contracts in the inlet stage, and the piezoelectric element expands in the outlet stage.

3. The piezoelectric pump is claimed in claim 2, wherein in the inlet stage, a thickness of an edge of the piezoelectric element is greater than a thickness of a center of the piezoelectric element, and a distance between an edge of the first vibration plate and an edge of the second vibration plate is greater than a distance between a center of the first vibration plate and a center of the second vibration plate, wherein in the outlet stage, the thickness of the center of the piezoelectric element is greater than the thickness of the edge of the piezoelectric element, and the distance between the center of the first vibration plate and the center of the second vibration plate is greater than the distance between the edge of the first vibration plate and the edge of the second vibration plate.

4. The piezoelectric pump is claimed in claim 1, further comprising:

a first wire connected to the first vibration plate; and a second wire connected to the second vibration plate, wherein the first vibration plate and the second vibration plate provides the first electric field to the piezoelectric element in the inlet stage, and the first vibration plate and the second vibration plate provides the second electric field to the piezoelectric element in the outlet stage.

5. The piezoelectric pump is claimed in claim 1, further comprising a support structure connected to the first vibration plate or to the second vibration plate, and the support structure is connected to the housing.

6. The piezoelectric pump is claimed in claim 1, wherein the first vibration plate is separated from the housing, and the second vibration plate is separated from the housing.

7. The piezoelectric pump is claimed in claim 1, wherein in an initial state, the first vibration plate is parallel to the second vibration plate, and is separated from the second vibration plate.

8. The piezoelectric pump is claimed in claim 1, wherein a width of the first vibration plate and a width of the second vibration plate is each less than each of a width of the housing, a width of the inlet structure, and a width of the outlet structure, and each of the width of the first vibration plate, the width of the second vibration plate, the width of the housing, the width of the inlet structure, and the width of the outlet structure is measured in a same direction.

9. The piezoelectric pump is claimed in claim 1, wherein an area or a width of each of the first openings is less than an area or a width of each of the inlet holes, and is less than an area or a width of each of the first films, and an area or a width of each of the second opening is less than an area or a width of each of the outlet holes, and is less than an area or a width of each of the second films.

10. The piezoelectric pump is claimed in claim 1, wherein the first vibration plate and the second vibration plate are made of conductive materials, a toughness of a material of the housing is higher than each of a toughness of a material of the inlet structure and a toughness of a material of the outlet structure.

11. An electronic device comprising:

a chassis comprising a mounting hole; and a piezoelectric pump mounted on the mounting hole, and comprising:

a housing comprising a plurality of first openings and a plurality of second openings;

an inlet structure disposed on an inner surface of the housing, and comprising:

a plurality of first films covering the first openings;

an outlet structure disposed on an outer surface of the housing, and comprising;

a plurality of second films covering the second openings; and a piezoelectric vibration mechanism disposed in the housing, and comprising:

a first vibration plate disposed in the housing;

a piezoelectric element affixed to the first vibration plate; and a second vibration plate affixed to the piezoelectric element, wherein in response to the piezoelectric element is alternately applied with a first electric field and a second electric field by the first vibration plate and the second vibration plate, respectively, the piezoelectric element alternately contracts and expands to vibrate the first vibration plate and the second vibration plate, respectively, and a direction of the first electric field is opposite to a direction of the second electric field, wherein the air flows into the housing via the first openings by pushing the first films in an inlet stage, and the air flows out of the housing via the second openings by pushing the second films in an outlet stage.

12. The electronic device is claimed in claim 11, wherein the inlet structure comprises an inlet body comprising a plurality of inlet holes positioned correspondingly to the first openings, and the first films are connected to the inlet body, and in the inlet holes.

13. The electronic device is claimed in claim 11, wherein the outlet structure comprises an outlet body comprising a plurality of outlet holes positioned correspondingly to the second openings, and the second films are connected to the outlet body, and in the outlet holes.

* * * * *